73-151 SR
12/7/76 OR 3,995,479

United States Patent [19]

Chapman, III

[11] 3,995,479

[45] Dec. 7, 1976

[54] APPARATUS FOR PROTECTING DOWNHOLE INSTRUMENTS FROM TORSIONAL AND LATERAL MOVEMENTS

[75] Inventor: Joseph E. Chapman, III, Houston, Tex.

[73] Assignee: Schlumberger Technology Corporation, New York, N.Y.

[22] Filed: Nov. 1, 1974

[21] Appl. No.: 520,081

[52] U.S. Cl. ..... 73/151; 308/6 A
[51] Int. Cl.[2] ..... E21B 47/00
[58] Field of Search ..... 308/4 A, 4 R, 6 R, 6 A; 73/151

[56] References Cited

UNITED STATES PATENTS

| | | | |
|---|---|---|---|
| 1,898,074 | 2/1933 | Bailey | 308/6 A |
| 1,913,365 | 6/1933 | Bailey | 308/6 A |
| 1,923,328 | 8/1933 | Reed | 308/6 A X |
| 2,198,720 | 4/1940 | Edgecomb et al. | 308/6 A |
| 2,776,564 | 1/1957 | Montgomery et al. | 73/151 |
| 3,789,511 | 2/1974 | Groom et al. | 73/151 X |
| 3,827,294 | 8/1974 | Anderson | 73/151 |

*Primary Examiner*—Evon C. Blunk
*Assistant Examiner*—Michael Mar
*Attorney, Agent, or Firm*—Ernest R. Archambeau, Jr.; William R. Sherman; Stewart F. Moore

[57] ABSTRACT

In the representative embodiment of the invention herein, delicate instruments and electronics circuitry used for obtaining downhole measurements are mounted on an elongated support or chassis which is removably disposed within a tubular housing and uniquely restrained from movement in response to shocks and vibrations which might otherwise damage or destroy the components. In this preferred arrangement, at least one set of angularly-disposed transverse rollers of a somewhat-resilient material is mounted on the chassis and respectively arranged for being slightly compressed and rollingly engaged with the internal wall of the tubular enclosure as the chassis is inserted into the enclosure. Although the rollers enable the chassis to be readily moved into and out of its protective enclosure, the frictional restraint between the compressed rollers and the enclosure walls will be effective for reliably restraining the chassis and its components from both lateral and torsional movements in response to shocks and vibrations of a potentially-destructive magnitude.

13 Claims, 5 Drawing Figures

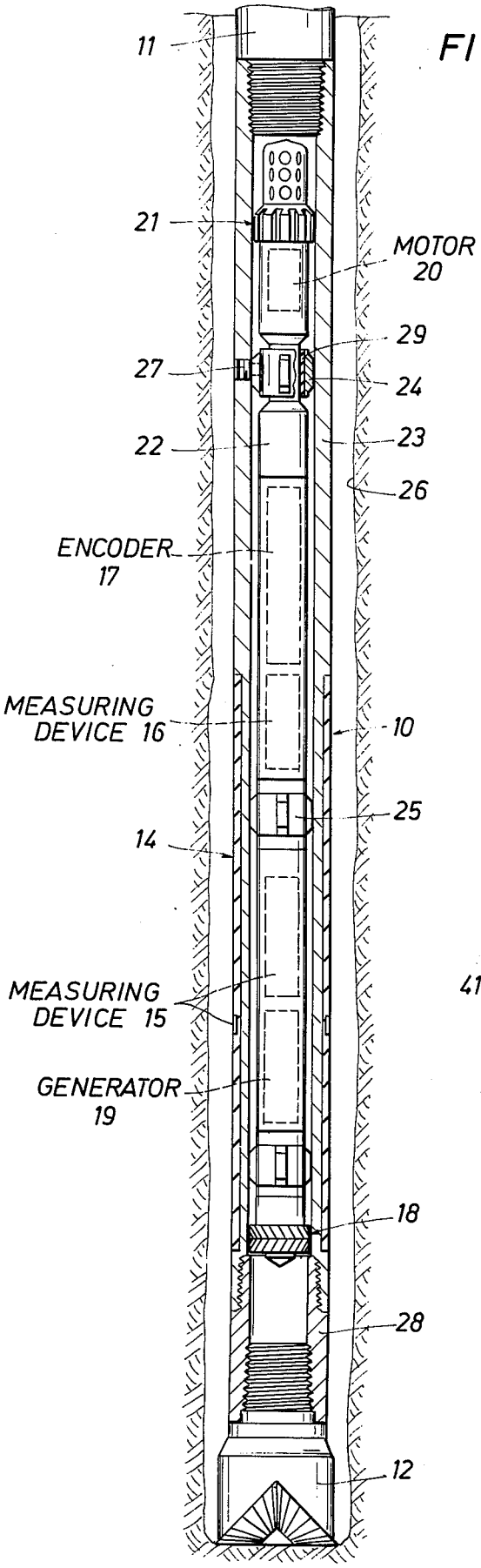
FIG. 1
FIG. 3
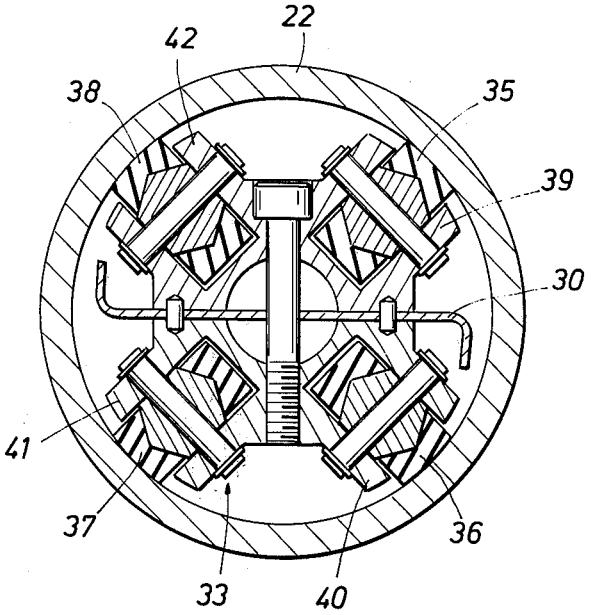

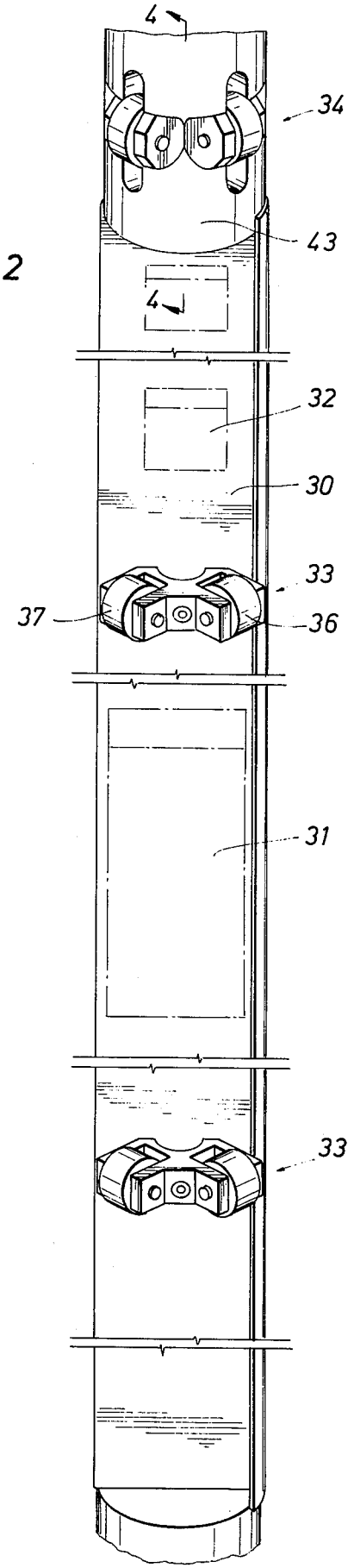
FIG. 2
FIG. 4
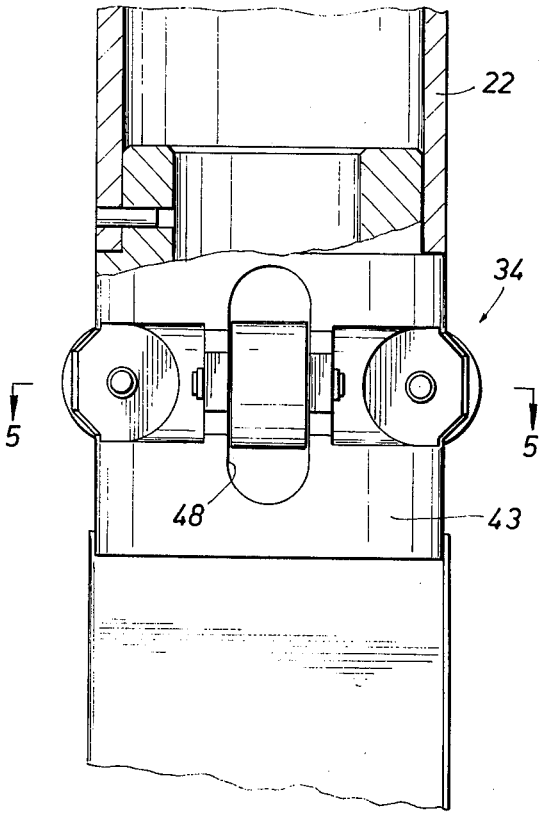
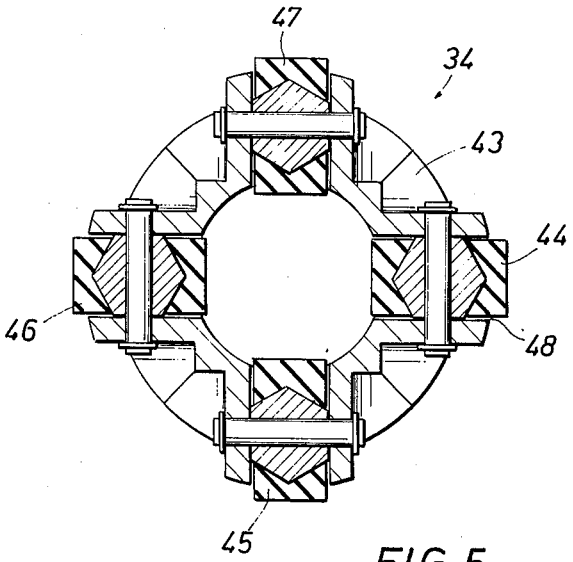
FIG. 5

APPARATUS FOR PROTECTING DOWNHOLE INSTRUMENTS FROM TORSIONAL AND LATERAL MOVEMENTS

Over the past 20 years or so various systems have been proposed for periodically transmitting measurements of one or more downhole conditions or formation characteristics to the surface during the drilling of a borehole with a rotary drill bit. However, there has heretofore been little or no commercial implementation of these proposed systems for various technical and economic factors. As a result, it was not until the great increase in drilling costs in recent years that such downhole "measuring-while-drilling" systems have become commercially feasible. As shown in U.S. Pat. No. 3,827,294, for example, one of the more-promising measuring-while-drilling systems of current interest employs a downhole electronic-measuring and acoustic-signaling assembly which is coaxially mounted within the drill string just above the drill bit and cooperatively arranged for producing encoded acoustic data signals which are successively transmitted through the circulating mud stream in the drill string to appropriate signal-decoding equipment at the surface.

Those skilled in the art will appreciate, of course, that these measuring systems necessarily require a considerable amount of downhole electronic circuitry for obtaining the desired sub-surface measurements and selectively operating the acoustic signaler for producing the encoded acoustic signals. It will also be recognized that space limitations as well as the severe borehole environmental conditions make it essential that the downhole electronic circuitry be sealingly enclosed in a small-diameter tubular enclosure of substantial length. To facilitate the repair and maintenance of the downhole assemby, its various circuit components and electronic elements are typically mounted along a narrow, elongated metal strip or chassis which is removably encased within the tubular enclosure. The enclosure must, of course, be completely sealed to protect its contents from the drilling mud flowng through the tool body around the tubular enclosure.

It will be recognized, moreover, that the downhole assembly must also be capable of withstanding the extreme shocks and severe vibrations which are ordinarily imposed on the measuring tool during a typical drilling operation. By way of example, impact or vibrational forces in the order of 20 to 25 times gravity are known to occur frequently. It is also recognized that in addition to such extreme lateral and longitudinal shocks, a typical drill string is also subjected to significant torsional forces and vibrations which, for example, are erratically developed as the rotating drill bit is momentarily slowed or halted by an obstruction on the bottom of the borehole and then resumes rotation as the bit breaks or cuts away the obstruction.

Those skilled in the art will recognize, therefore, that these severe torsional shocks particularly represent a major problem in designing the downhole electronics package to withstand these continued shocks. The necessity to arrange the electronics into an elongated and relatively-slender assembly will, of course, make the assembly particularly susceptible to torsional forces unless it is securely anchored at spaced intervals along its length. Nevertheless, it is not practical to simply anchor the electronics chassis or cartridge housing at numerous longitudinally-spaced positions since this will both unduly complicate the disassembly and assembly of the downhole unit as well as needlessly create numerous potential leakage paths into the enclosed housing.

Accordingly, it is an object of the present invention to provide new and improved downhole measuring and signaling systems that are cooperatively arranged for reliably withstanding severe torsional and lateral forces but which also have a minimum number of possible leakage paths as well as being readily easy to assemble and disassemble.

This and other objects of the present invention are attained by mounting one or more sets of angularly-disposed transversely-oriented rollers formed of a material having at least minimal resilience at selected locations along an elongated body or chassis which is arranged to be longitudinally inserted into a protective tubular enclosure with the rollers being respectively disposed in rolling engagement with circumferentially-spaced portions of its interior wall to facilitate the insertion and withdrawal of the body or chassis. By appropriately sizing the rollers to be at least slightly compressed as the body or chassis is moved into the tubular member, each roller will be frictionally engaged thereagainst for firmly restraining the body or chassis against transverse movement under torsional or lateral forces without unduly limiting its longitudinal movement into and out of the larger member.

The novel features of the present invention are set forth with particularity in the appended claims. The invention, together with further objects and advantages thereof, may be best understood by way of the following description of exemplary apparatus employing the principles of the invention as illustrated in the accompanying drawings, in which:

FIG. 1 schematically illustrates a typical measuring-while-drilling tool including new and improved apparatus incorporating the principles of the present invention;

FIG. 2 shows a preferred embodiment of the present invention where an elongated electronics chassis of a typical design is cooperatively restrained against torsional or lateral movements in relation to a protective tubular housing carried within the well tool depicted in FIG. 1; and FIGS. 3–5 depict various details of the new and improved torsional motion restrainers shown in FIG. 2.

Turning now to FIG. 1, a new and improved well tool 10 arranged in accordance with the present invention is depicted coupled in a typical drill string 11 and having a rotary drill bit 12 dependently coupled thereto for excavating a borehole 13 through various earth formations. As the drill string 11 is rotated by a typical drilling rig (not shown) at the surface, substantial volumes of drilling fluid or a so-called "mud" are continuously pumped downwardly through the tubular drill string and discharged from the drill bit 12 to cool the bit as well as to carry earth cuttings removed by the bit to the surface as the mud is returned upwardly along the borehole 13 exterior of the drill string to a storage pit or surface vessel (not shown) for subsequent recirculation by the mud pumps. It will be appreciated, therefore, that the circulating mud stream flowing through the drill string 11 serves as a transmission medium that is well suited for transmitting acoustic signals to the surface at the speed of sound in the particular drilling fluid.

As is typical, data-transmitting means 14 are arranged on the well tool 10 and include one or more typical formation-property or condition-responsive measuring devices, as shown generally at 15 and 16, respectively coupled to an appropriate measurement encoder 17 operatively arranged to produce a series of electrical coded data signals that are representative of the several measurements being obtained by the measuring devices. Although a self-contained battery power supply could be employed, as shown generally at 18 it is preferred to employ a multi-bladed turbine driving a generator 19 for utilizing the circulating mud stream as a motivating source to generate electric power for operation of the data-transmitting means 14. The data-transmitting means 14 further include an electric motor 20 which is coupled to the encoder 17 and, as shown for example in U.S. Pat. No. 3,764,970, operatively arranged to respond to its coded output signals for rotatively driving an acoustic signaler 21 to successively interrupt or obstruct the flow of the drilling fluid through the drill string 11. The resulting acoustic signals produced by the acoustic signaler 21 will be transmitted to the surface through the mud stream flowing within the drill string 11 as encoded representations or data signals indicative of the one or more downhole conditions or formation properties respectively sensed by the various measuring devices 15 and 16. As these data signals are successively transmitted to the surface, they are detected and converted into meaningful indications or records by suitable acoustic signal detecting-and-recording apparatus (not shown) such as that disclosed, for example, in U.S. Pat. No. 3,555,504.

In light of the previous discussion, it will, of course, be appreciated that most of the components comprising the data-transmitting means 14 must necessarily be isolated from the drilling mud flowing through the well tool 10. Accordingly, in the preferred embodiment of the tool 10 depicted in FIG. 1, the data-transmitting means 14 are arranged generally as illustrated with the acoustic signaler 21 and the turbine-generator 18 being respectively mounted on the upper and lower ends of an elongated, tubular enclosure or fluid-tight housing 22 supported within the body 23 of the tool. As illustrated, the instrumentation housing 22 is coaxially aligned within the tool body 23 by means such as one or more longitudinally-spaced multi-armed centralizers or so-called spiders, as at 24 and 25, for cooperatively defining an annular fluid passage 26 around the housing sufficient to accommodate the downwardly-flowing drilling mud.

To facilitate the servicing of the data-transmitting means 14, it is preferred that this entire assembly be suspended from laterally-directed support pins, as at 27, which are threaded into the tool body to respectively couple their inwardly-projecting ends to the several arms of the uppermost centralizer 24. Thus, to remove the data-transmitting means 14 from the tool body 23, it is necessary only to unthread the coupling pins 27 and pull the assembly including the turbine-generator 18, the signaler 21 and the elongated housing 22 out of the body.

To protect the assembly carrying the data-transmission means 14 from the extreme longitudinally-directed shocks which will be imposed on the tool 10 during a typical drilling operation, it is preferred to resiliently suspend the housing 22 from the tool body 23. Accordingly, as illustrated in FIG. 1, in the preferred embodiment of the tool 10 the uppermost centralizer 24 is cooperatively coupled to the instrumentation housing 22 by means of a thick sleeve 29 of an elastomeric or other shock-absorbing material which is tightly bonded to the centralizer and the housing. Thus, it will be appreciated that the elastomeric sleeve 29 will, for the large part, effectively isolate the data-transmission means 14 from longitudinally-directed shocks or vibrations which will ordinarily occur during a drilling operation. On the other hand, the relatively-close annular clearance between the centralizers 24 and 25 and the inner wall of the body 23 will at least minimize any substantial lateral movements of the freely-suspended housing 22 which could otherwise cause damage to the electronic components in the instrumentation housing whenever the tool 10 is subjected to transversely-directed impacts or vibrations. Alternatively, one or more of the intermediate centralizers, as at 25, may be arranged in accordance with the new and improved pressure-actuated torsion-restraining centralizers disclosed in a copending application (20.2065) by Walter E. Cubberly, Jr. filed simultaneously herewith.

As previously discussed, however, it is not at all uncommon for the tool 10 to be also subjected to severe torsional forces or vibrations which can ultimately damage or destroy various components and delicate elements contained within the instrumentation housing 22. It will be appreciated, for example, that when the rotational speed of the tool body 23 is suddenly reduced or increased as previously described, there will be corresponding rotational inertial forces imposed on the instrumentation housing 22 as well as its contents. Thus, as schematically depicted in FIG. 2, where the electronic circuitry included in the data-transmission means 14 is arranged on an elongated metal strip or chassis 30 disposed within the instrumentation housing 22, these inertial forces will have a significant effect on any transformers or other massive components, as at 31, mounted on the chassis. Lighter components, as at 32, will, of course, be less affected than the heavier or more-massive elements. In either case, however, it will be appreciated that substantial rotational inertial forces acting on the data-transmission means 14 will readily tend to twist the enclosed chassis 30 back and forth about its longitudinal axis unless the chassis is secured to the enclosure 22 at one or more longitudinally-distributed points.

Accordingly, in keeping with the principles of the present invention, the instrumentation package of the data-transmission means 14 is provided with one or more torque-restraining means, as at 33 and 34 generally, which are mounted at selected intervals along the length of the instrumentation package contained in the protective housing 22 and cooperatively arranged for operative engagement with the internal wall of the housing as the chassis 30 is moved into and out of the housing. Taking the torque-restraining means 33 for example, it will be seen that in this preferred embodiment of the present invention, four small-diameter rollers 35–38 of a somewhat-resilient elastomeric material are respectively journalled on the outer ends of four outwardly-directed chassis projections or angularly-disposed lateral arms, as at 39–42, and cooperatively positioned in relation to the chassis 30 so that the rollers will individually roll along longitudinal paths circumferentially spaced about the inner wall of the housing 22 as the chassis is being inserted into or moved therefrom.

Of particular importance for accomplishing the objects of the present invention, the torque-restraining means 33 and 34 are cooperatively arranged to cause each of the rollers, as at 35–38 for example, to be slightly compressed as it is rolled into the open end of the tubular housing 22. Thus, although such minimal compression of the several rollers, as at 35–38, will not significantly retard the longitudinal movements of the chassis 30 in relation to the housing 22, the frictional restraint resulting from the compression of the rollers against the housing wall will substantially limit, if not altogether prevent, any rotational or torsional movements of the chassis and its several components in relation to the housing. It should be noted that since each of the rollers, as at 35–38 is to be subjected to substantial laterally-directed forces tending to move its elastomeric element off of its metal hub, it is preferred to form the hub with an enlarged mid-portion as illustrated so as to better support the elastomeric rim against lateral movement. It will, of course, be recognized that the amount of frictional restraint provided individually by each of the rollers, as at 35–38, will be dependent upon the diameter and thickness of the elastomeric rim of the roller as well as the amount of its radial compression. Similarly, the overall frictional restraint provided for restraining torsional movements of the chassis 30 will be directly related to the number of rollers, as at 35–38, with each torque-restraining means, as at 33, as well as to the overall number of torque-restraining means employed.

Those skilled in the art will, of course, appreciate that it is often desired to mount the various electronic components in an electronics package, as at 31, on a number of chassis strips, as at 30, which are tandemly coupled between cylindrical coupling members or so-called "bulkheads" as at 43. Accordingly, in applying the principles of the present invention to such bulkheads as at 43, it has also been found useful to arrange torque-restraining means, as at 34, on these bulkhads as illustrated. Hereagain, as in the case of the torque-restraining means 33, the preferred embodiment of the torque-restraining means 34 includes four angularly-disposed rollers 44–47 which are arranged in circumferentially-spaced elongated recesses, as at 48, around the bulkhead 43 and cooperatively journalled thereon for easy rotation along longitudinal paths running along the inner wall of the housing 22 as the chassis 30 is moved into and out of the housing. The orientation of the rollers 44–47 will, of course, also limit or restrain rotation of the bulkhead 43 in relation to the housing 22 in the same manner as already explained in reference to the torque-restraining means 33.

Since electronic components are typically rated to withstand accelerational forces at least in the order of 10 times the force of gravity, it is ordinarily preferred to design the one or more shock-dampening or torque-restraining means 33 and 34 for frictionally restraining twisting of the chassis 30 and its associated instrumentation package 31 within the housing 22 until these torsional forces exceed this selected level. Those skilled in the art will recognize, of course, that selection of this design criteria will mean that the overall or combined frictional forces developed by the several rollers, as at 35–38 and 44–47 would be equal to 10 times the combined weight of the chassis 30 and the electronics package 31. Thus, with a given coefficient of friction, the total cross-sectional areas of the engaged portions of the rollers 35–38 and 44–47 as well as the compressive forces imposed by the rollers can be readily designed for providing this desired torsional restraining force.

As previously mentioned, these suddenly-imposed accelerational or impact forces are not the only factor to be considered in protecting the instrumentation package 31. In particular, those skilled in the art will realize that there will also be sustained low-order vibrations acting on the instrumentation housing 22 which, if allowed to go unchecked, can similarly damage the data-transmitting means 14. Accordingly, it is of equal importance in the practice of the present invention to understand that the new and improved shock-dampening means 33 and 34 are also uniquely effective for protecting the contents of the instrumentation housing 22 from torsional vibrations which themselves are of lesser magnitude than the impact or accelerational forces discussed above. Since those skilled in the art can readily understand the principles of the present invention without a full development of the applicable underlying theory of vibrational analysis involved here, it is believed sufficient to simply state that it can be demonstrated that the most-destructive condition which the electronics package 31 can be subjected to is where the chassis 30 is unrestrained and the torsional vibrations acting thereon are at the natural vibrational frequency of the elastomeric sleeve 29 carrying the housing 22. Under this resonant condition, the instrumentation housing 22 would be moved or turned through an arc far greater than the oscillatory arc through which the tool body 23 is being twisted as a result of these torsional vibrations.

Under typical drilling conditions, it can, of course, be demonstrated that the frequency of these torsional vibrations is ordinarily somewhat less than the aforementioned natural frequency. Nevertheless, this does not mean that these low-frequency vibrations are of no consequence since, if they are unchecked, the contents of the housing 22 can be easily damaged. The frictional forces supplied by the new and improved torque-restraining or shock-dampening means 33 and 34 of the present invention can, however, be shown as providing significant dampening effects which are directly related to the magnitude of the outwardly-acting frictional forces imposed by the several compressed rollers 35–38 and 44–47.

Accordingly, it will be recognized that the new and improved torque-restraining means of the present invention as described herein are particularly effective for limiting, if not altogether preventing, torsional movements of an elongated chassis carrying electronic components and disposed within a tubular protective housing. In addition to providing substantial resistance to twisting of the chassis without unduly hindering its longitudinal movements into and out of the housing, the slight resilience of the several rollers included with the new and improved torque-restraining means of the present invention will further serve to cushion the chassis and its components against lateral shocks and vibrations. Thus, in keeping with the objects of the present invention, the new and improved torque-restraining means described herein are seen to be particularly effective for isolating delicate downhole instruments from potentially-damaging lateral and torsional shocks and vibrations imposed on well bore tools.

While only a particular mode of practicing the invention has been shown and described, it is apparent that changes and modifications may be made without departing from this invention in its broader aspects; and, therefore, the aim in the appended claims is to cover all such changes and modifications as fall within the true spirit and scope of this invention.

What is claimed is:

1. Well bore instrumentation apparatus adapted for suspension in a well bore and comprising:

an elongated outer tool body having a longitudinally-aligned, elongated instrumentation chamber therein with one end of said outer body being arranged for providing direct access into said elongated chamber;

an elongated inner tool body having instrumentation means thereon and adapted for insertion into said one end of said outer body and longitudinal movement within said elongated chamber to a selected fixed position therein; and shock-isolating means adapted for cooperatively supporting said inner body in its said fixed position within said elongated chamber and yieldably isolating said instrumentation means from shock forces imposed on said outer body, said shock-isolating means including a plurality of rollers with at least the rims of said rollers being respectively formed of a resilient material and cooperatively sized for being compressed upon insertion of said inner body into said elongated chamber and means cooperatively journalling and supporting said rollers at spaced intervals around one of said bodies and adapted for bringing and maintaining each of said rollers in rolling yieldable engagement along a longitudinal path on the other of said bodies upon progressive insertion of said inner body into said elongated chamber and developing a restraining frictional force opposing torsional movements of said inner body induced by said shock forces when said inner body reaches its said fixed position.

2. The well bore instrumentation apparatus of claim 1 wherein said one body is said inner body; and at least two of said rollers are mounted in opposition on said inner body and respectively arranged for being frictionally engaged against the opposed side walls of said elongated chamber.

3. The well bore instrumentation apparatus of claim 2 wherein at least one portion of said inner body is an elongated strip having substantially-planar opposite faces on which said two rollers are mounted.

4. The well bore instrumentation apparatus of claim 2 wherein said inner body includes at least one transversely-directed portion thereof having angularly-disposed surfaces on which said two rollers are mounted.

5. The well bore instrumentation apparatus of claim 1 wherein said one body is said inner body; said first and second sets of said rollers are respectively mounted in opposition to one another on longitudinally-separated first and second portions of said inner body and cooperatively positioned thereon for resiliently compressing said roller rims against the opposed side walls of said elongated chamber as said inner body is being moved to its said fixed position.

6. The well bore instrumentation apparatus of claim 5 wherein at least a major part of said second body including said first and second body portions is an elongated strip having substantially-planar opposite faces on which said first and second sets of rollers are mounted.

7. The well bore instrumentation apparatus of claim 5 wherein said first body portion is an elongated strip having substantially-planar opposite faces on which said first set of rollers is mounted and said second body portion is transversely oriented with respect to said first body portion for defining angularly-disposed surfaces on which said second set of rollers is mounted.

8. Well bore instrumentation apparatus comprising:

a tubular tool body adapted for being coupled in a drill string to be suspended in a well bore;

a tubular instrumentation housing having an internal bore defining an elongated chamber and cooperatively mounted within said tool body for defining an annular flow passage around said instrumentation housing and within said tool body to conduct drilling fluids flowing therethrough;

an elongated instrumentation support having instrumentation means mounted thereon and adapted for positioning in a selected fixed location within said elongated chamber; and shock-isolating means cooperatively arranged on said instrumentation support and adapted for yieldably supporting said instrumentation support within said elongated chamber to isolate said instrumentation means from shock forces and vibrations and including a plurality of rollers formed of a resilient material, and means cooperatively journalling and supporting said rollers at spaced intervals along said instrumentation support for compressing and maintaining each of said rollers in rolling frictional engagement along spaced longitudinal paths on the internal walls of said instrumentation housing upon insertion of said instrumentation support in said elongated chamber and for developing restraining frictional forces opposing torsional movements of said instrumentation support once it has been positioned in its said fixed location.

9. The well bore instrumentation apparatus of claim 8 wherein at least two of said rollers are mounted on said instrumentation support in substantial opposition to one another and cooperatively positioned for being respectively compressed against said housing walls as said instrumentation support is being inserted into said elongated chamber to develop a combined frictional holding force of at least a predetermined magnitude.

10. The well bore instrumentation apparatus of claim 8 wherein said instrumentation support has at least one portion thereof formed as an elongated strip with substantially-planar opposite faces on which at least two of said rollers are respectively mounted and cooperatively positioned for being respectively compressed against said housing walls as said instrumentation support is being inserted into said elongated chamber for frictionally anchoring said one body portion against torsional movements and vibrations.

11. The well bore instrumentation apparatus of claim 8 wherein said instrumentation support includes at least one tranversely-directed portion thereof having angularly-disposed surfaces on which at least two of said rollers are respectively mounted and cooperatively positioned for respectively compressing them as said instrumentation support is being inserted into said elongated chamber to develop a combined frictional holding force of at least a predetermined magnitude for anchoring said instrumentation support against torsional movements and vibrations.

12. The well bore instrumentation apparatus of claim 8 wherein said instrumentation support includes at least a first elongated strip portion having substantially-planar opposite faces on which at least a first set of said rollers are respectively mounted and also includes a second transversely-directed portion having angularly-disposed surfaces on which a second set of said rollers are respectively mounted, said first and second sets of rollers being cooperatively positioned on said instrumentation support for respectively compressing them as said instrumentation support is being inserted into said elongated chamber for frictionally anchoring said first and second support portions against torsional movements and vibrations within said instrumentation housing.

13. The well bore instrumentation apparatus of claim 8 wherein said means cooperatively journalling and supporting said rollers include a hub member having an enlarged mid-portion respectively carrying each of said rollers, with each of said rollers being complementally fitted onto its associated hub member so that said enlarged mid-portions of said hub members will support said rollers against lateral movement in relation to said hub members.

* * * * *